US009877885B2

(12) United States Patent
Trepanier et al.

(10) Patent No.: US 9,877,885 B2
(45) Date of Patent: Jan. 30, 2018

(54) EMERGENCY STOP (LOCKOUT) SYSTEM FOR PATIENT HOISTS/LIFTS

(75) Inventors: André Trepanier, Repentigny (CA); Olivier Custeau-Boisclair, Sherbrooke (CA); Martin Faucher, Magog (CA); Serge Lang, Valcourt (CA); Stéphane Lebrun, Sherbrooke (CA)

(73) Assignee: ArjoHuntleigh Magog Inc. (CA)

( * ) Notice: Subject to any disclaimer, the term of this patent is extended or adjusted under 35 U.S.C. 154(b) by 441 days.

(21) Appl. No.: 14/009,576

(22) PCT Filed: Jul. 9, 2012

(86) PCT No.: PCT/CA2012/050464

§ 371 (c)(1), (2), (4) Date: Dec. 30, 2013

(87) PCT Pub. No.: WO2013/016817

PCT Pub. Date: Feb. 7, 2013

(65) Prior Publication Data

US 2014/0143952 A1 May 29, 2014

(30) Foreign Application Priority Data

Aug. 3, 2011 (CA) ..... 2747926

(51) Int. Cl.
*A61G 7/10* (2006.01)

(52) U.S. Cl.
CPC ..... *A61G 7/1063* (2013.01); *A61G 7/1001* (2013.01); *A61G 7/1015* (2013.01); (Continued)

(58) Field of Classification Search
CPC .... B66D 3/02; B66D 3/26; B66D 3/18; B66C 13/18; B66C 13/22; A61G 2203/726; (Continued)

(56) References Cited

U.S. PATENT DOCUMENTS 2,891,256 A * 6/1959 Scully ..... A61G 7/1015 182/4
2,898,083 A * 8/1959 Kresl ..... B66D 3/24 254/273

(Continued)

FOREIGN PATENT DOCUMENTS

CN 101801324 A 8/2010
CN 101862246 A 10/2010

(Continued)

OTHER PUBLICATIONS

International Search Report of PCT/CA2012/050464, dated Sep. 16, 2012, 2 pages.

*Primary Examiner* — Robert G Santos
*Assistant Examiner* — David R Hare
(74) *Attorney, Agent, or Firm* — The Webb Law Firm

(57) ABSTRACT

A patient lift including a lifting member and a hoist assembly connected to the lifting member. The hoist assembly has an enabled state to move the lifting member between a raised position and a lowered position, and a disabled state wherein the hoist assembly cannot move the lifting member between the raised and lowered positions. An elongated switch member descends from the hoist assembly such that the switch member is reachable by an operator. Urging the switch member in a first direction in an axial sense along the length of the elongated switch member or a rotational sense about the length of the elongated switch member, places the hoist assembly in the enabled state or the disabled state. Urging the switch member in a second direction different from the first direction places the assembly in the other of the enabled state and the disabled state.

30 Claims, 9 Drawing Sheets

(52) U.S. Cl.
CPC ..... *A61G 7/1073* (2013.01); *A61G 7/1042* (2013.01); *A61G 7/1051* (2013.01); *A61G 7/1061* (2013.01); *A61G 2203/726* (2013.01)

(58) Field of Classification Search
CPC ..... A61G 7/10; A61G 7/1001; A61G 7/1013; A61G 7/1015; A61G 7/1023; A61G 7/1063; A61G 7/1065; A61G 7/10731; A61G 7/1061; A61G 7/1042; A61G 7/1051
See application file for complete search history.

(56) References Cited

U.S. PATENT DOCUMENTS 3,123,224 A * 3/1964 Kral ..... A61G 7/1019 212/330
3,852,835 A * 12/1974 Whitaker ..... A61G 7/1003 4/562.1
3,858,845 A * 1/1975 Grote ..... B66C 13/00 254/266
4,125,908 A * 11/1978 Vail ..... A61G 7/1015 104/94
4,180,346 A 12/1979 Blake
4,202,064 A * 5/1980 Joergensen ..... A61G 7/1015 212/312
4,243,147 A * 1/1981 Twitchell ..... A61G 7/1015 104/172.1
4,606,082 A * 8/1986 Kuhlman ..... A61G 5/00 280/304.1
4,627,119 A * 12/1986 Hachey ..... A61G 7/1015 5/85.1
4,635,903 A * 1/1987 Broyden ..... B66D 3/26 174/DIG. 12
4,944,056 A * 7/1990 Schroeder ..... A61G 7/1015 5/85.1
5,133,465 A * 7/1992 Kalan ..... B66C 13/22 212/276
5,327,592 A * 7/1994 Stump ..... A61G 7/1015 254/362
5,511,256 A * 4/1996 Capaldi ..... A61G 7/1015 403/217
5,694,654 A * 12/1997 Roy ..... A61G 7/1015 5/83.1
5,809,591 A * 9/1998 Capaldi ..... A61G 7/1015 5/83.1
6,035,465 A * 3/2000 Rogozinski ..... A61G 5/02 5/83.1
6,170,606 B1 * 1/2001 Merz ..... B66F 9/20 182/148
6,543,578 B1 * 4/2003 Merz ..... B66C 13/56 182/148
7,021,427 B2 * 4/2006 Skovgaard ..... A61G 7/1015 187/281
7,350,247 B2 * 4/2008 Bogh-Sorensen ... A61G 7/1015 5/83.1
8,978,905 B2 * 3/2015 Bergenstråle et al. ..... A61G 7/1042 212/324
9,334,143 B2 * 5/2016 Ogawa ..... B66C 13/40
2004/0118639 A1 6/2004 Skovgaard et al.
2009/0188038 A1 7/2009 Raney
2010/0187379 A1 7/2010 Kragh et al.
2010/0270252 A1 10/2010 Chepurny et al.
2011/0219538 A1 9/2011 McWattie et al.
2011/0225728 A1 9/2011 Thornhill et al.

FOREIGN PATENT DOCUMENTS

GB 2260195 A 4/1993
JP 275494 U1 6/1990
JP 3048148 U 5/1998
JP 2005111113 A 4/2005
WO 02087720 A1 11/2002

* cited by examiner 200
220
222
226
228
230
232
236
238
240
250
262
264
266
270
280
290
294
296
298

EMERGENCY STOP (LOCKOUT) SYSTEM FOR PATIENT HOISTS/LIFTS

This is a U.S. National Phase of PCT/CA2012/050464, filed Jul. 9, 2012, which claims the benefit of priority to CA 2747926, filed Aug. 3, 2011, which is incorporated herein by reference.

FIELD OF THE INVENTION

This document concerns an invention relating to patient hoists for lifting patients whose mobility is impaired, particularly patient hoists which ride along ceiling-mounted tracks. The invention more specifically relates to emergency stop systems for such patient hoists.

BACKGROUND OF THE INVENTION

Patient hoists, also referred to as patient lifts, are commonly used to raise, lower, and transport patients who are disabled or who otherwise have mobility problems. Two common types of patient hoists are the stanchion-mounted hoist and the ceiling hoist. Stanchion-mounted hoists often have a hoist assembly situated at the upper end of a stanchion having a wheeled base, whereby the hoist assembly can be wheeled to different locations. A lifting member (e.g., a spreader bar bearing a patient harness, a sling, or a spreader bar bearing a harness or sling) descends from the hoist assembly on a strap, cable, or other flexible length of material which may be wound or unwound from a motorized spool situated within the hoist assembly. Thus, for example, the hoist might be wheeled to position the hoist assembly and lifting member over or adjacent to a patient; the lifting member can be lowered to receive the patient; and the hoist assembly may then raise the lifting member and patient so that they may be wheeled elsewhere (e.g., to a bathtub) to be lowered and placed. Ceiling hoists are similar, but tend to have their hoist assemblies movably engaged to ceiling-mounted tracks such that the hoist assembly can be moved about the track from location to location, e.g., between a patient's bed and bathroom.

The controls for stanchion-mounted hoists tend to be on the stanchions and/or on the stanchion-mounted hoist assemblies, whereas the controls for ceiling hoists tend to be on wall-mounted controls and/or on the ceiling-mounted hoist assemblies. Wall-mounted controls can be problematic for ceiling hoists because the controls may not be within easy reach of the patient's caregiver while he or she is standing near the patient. Similarly, controls mounted on ceiling-mounted hoist assemblies can be too high to conveniently reach (if they can be reached at all): a user may need to fetch a stepladder or stool to adjust the controls and difficulties may arise if the patient is suspended below the hoist assembly in the region where the caregiver needs to situate the stepladder/stool. Out-of-reach controls pose particular problems when a lifting operation needs to be urgently terminated, e.g., if lifting causes pain to the patient, or if it appears during lifting that the patient is in danger of falling. For this reason, ceiling hoists sometimes bear emergency stop or "lockout" switches that can be conveniently reached by caregivers standing next to or below the hoists. A common switch of this type resembles a pull-cord for an electric light, and has a flexible cord descending from the hoist assembly. A first pull on the cord disables the hoist, i.e., halts lifting or lowering of the lifting member and/or halts other motion, such as motion of the hoist assembly along any associated ceiling-mounted track, tilting of the hoist assembly (or a portion thereof) with respect to the track, etc. A second pull on the cord then re-enables the hoist assembly, i.e., allows motion of the lifting member with respect to the hoist assembly and/or allows other motion. A disadvantage of these types of switches is that their use of the same type of (pull-and-release) motion for hoist activation and deactivation can lead to mistaken activation after deactivation occurs, owing to events such as caregiver error (e.g., the caregiver's hand "bouncing" on the cord during an emergency stop situation), owing to the cord's catching on an item in the cord's surroundings, or other factors.

Other emergency switches similarly allow hoist operation to be disabled upon pulling a flexible cord or strap, but a user must then actuate a second switch situated on the hoist assembly to re-enable hoist operation. Since the first (enable) switch (the cord) is separate from the second (enable) switch on the hoist assembly, this arrangement deters accidental re-enablement of the hoist assembly. However, re-enabling the hoist assembly is inconvenient and time-consuming owing to difficulty in conveniently reaching the second switch, as discussed above. It would therefore be useful to have available emergency stop or "lockout" switches for patient hoists which are readily reachable from the floor at areas below and/or adjacent to the hoists, and which allow disabling and re-enabling of the hoists from these areas, while protecting against accidental re-enablement.

SUMMARY OF THE INVENTION

The invention, which is defined by the claims set forth at the end of this document, is directed to patient hoists (and switch arrangements for patient hoists) which at least partially alleviate the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings, which are briefly reviewed in the "Brief Description of the Drawings" section following this Summary section of this document. Since the following discussion is merely a summary, it should be understood that more details regarding the preferred versions may be found in the Detailed Description set forth elsewhere in this document. The claims set forth at the end of this document then define the various versions of the invention in which exclusive rights are secured.

Referring to FIGS. 1A-1B, an exemplary patient hoist suitable for use with the invention includes a hoist assembly 10, a lifting member 14 descending therefrom, and a switch member 20 extending from the hoist assembly 10. Different versions of the invention primarily involve switch arrangements which resemble those in FIGS. 1A-1B, but with differences as described below. The hoist assembly 10 has a height measured in a vertical direction, and during operation it exhibits an enabled state and a disabled state. In the enabled state—which will typically be the ordinary operating state of the patient hoist—the hoist assembly 10 can move the lifting member 14 between a raised position situated closer to the hoist assembly 10, and a lowered position located more distantly from the hoist assembly 10. Preferably, the range of motion between the raised position and the lowered position is greater than the height of the hoist assembly 10. In the disabled state, the hoist assembly 10 cannot move the lifting member 14 between the raised position and the lowered position, and thus the disabled state defines an emergency stop or "lockout" state for the patient hoist.

The switch member 20 descends from the hoist assembly 10 to a switch member operating end 22 situated below the hoist assembly 10, and is preferably sized such that an operator (such a caregiver for a patient) can readily reach the switch member operating end 22 while standing on the floor. To characterize the dimensions of the switch member 20 in different terms, the switch member 20 preferably has a length measured in the vertical direction which is at least substantially the same as, or greater than, the height of the hoist assembly 10, and such that the operating end 22 is situated below the raised position of the lifting member 14 and above the lowered position of the lifting member 14 (i.e., the range of motion of the lifting member 14 is preferably greater than the length of the switch member 20). It is preferred that the switch member 20 be at least substantially rigid, whereby it can readily transmit torsion and pulling/pushing forces along its length, and whereby it can be cantilevered from one of its ends without substantial bending.

The patient hoist is configured such that the hoist assembly 10 is disabled by moving the switch member 20 with a first type of motion, with the hoist assembly 10 thereafter being enabled by the switch member 20 only when the switch member 20 is moved with a second type of motion different from the first type. More specifically, if a switch motion is regarded as being defined by a sense (e.g., rotational or axial) and a direction (e.g., clockwise, counterclockwise, or in one of two opposing axial directions), the hoist assembly 10 is placed in one of the enabled state or the disabled state by urging the switch member 20 in a first direction oriented either in an axial sense along the length of the elongated switch member 20, or in a rotational sense about the length of the elongated switch member 20. The hoist assembly 10 is thereafter placed in the other of the enabled state or the disabled state by urging the switch member 20 in a second direction oriented differently than the first direction. As a result, provided the switch member 20 has sufficient length, a caregiver can actuate the switch member 20 from the floor (or a patient can actuate the switch member 20 from a sling or the like) to disable the hoist assembly 10 in an emergency situation. The caregiver can then re-enable the hoist assembly 10 using the switch member 20 without the need to walk to a wall-mounted override control or otherwise leave the patient. Further, the re-enabling is effected by a motion which, being different from the disabling motion, is not as easy to accidentally trigger.

A first example of a switch assembly 200 suitable for use in the foregoing arrangement is illustrated in FIGS. 2A-2D, wherein an elongated switch member 220 disables and enables a hoist assembly (such as the hoist assembly 10) using a pull-push action. Here the switch member 220 includes an elongated outer switch member 226 having an internal passage 228 along its length, and an elongated inner switch member 236 having at least a substantial portion of its length telescopically fit within the internal passage 228 of the outer switch member 226 (as best seen in FIGS. 2B-2D). The inner switch member 236 is movable within the outer switch member 226 in an axial sense along the length of the elongated switch member 220, and is linked to a switch actuating member 250 which is movably mounted within a switch enclosure 270 situated about a switch 290. The switch actuating member 250 engages the switch 290, and may actuate the switch 290 to place the hoist assembly 10 in the enabled state or the disabled state. The outer switch member 226 has an outer circumference having a protrusion 230 extending therefrom next to the switch member operating end 222, whereas the inner switch member 236 has a inner switch member terminal end 238 protruding from the outer switch member 226 next to the protrusion 230. Owing to interference between the protruding inner switch member terminal end 238 and the outer switch member 226, the inner switch member 236 travels with the outer switch member 226 when the outer switch member 226 is urged toward the inner switch member terminal end 238 (as seen between FIGS. 2B-2C), but the inner switch member 236 need not follow the outer switch member 226 when the outer switch member 226 moves in the opposite direction (as seen between FIGS. 2C-2D). A spring 294 biases the outer switch member 226 with respect to the switch enclosure 270 toward the switch actuating member 250 in such a manner that the outer switch member 226 is urged in a direction away from the inner switch member terminal end 238 (with the spring 294 shown in an uncompressed/fully extended state in FIG. 2B).

Urging the switch member 220 in a first direction oriented in an axial sense along the length of the switch member 220 (e.g., by grasping the protrusion 230 of the outer switch member 226 and pulling it downwardly, as illustrated between FIGS. 2B-2C) places the hoist assembly 10 in the disabled state. When this is done, the inner switch member 236 travels with the outer switch member 226, and thus the switch actuating member 250 acts on the switch 290 to place the hoist assembly 10 in the disabled state. When the protrusion 230 is released in FIG. 2B, the spring 294 urges the outer switch member 226 upwardly to space it from the inner switch member terminal end 238, as seen in FIG. 2D. The hoist assembly 10 can thereafter be placed in the enabled state by axially urging the switch member 220 in a second direction oriented along its length, and opposite the first direction, e.g., by pushing the switch member 220 of FIG. 2D, and more particularly its inner switch member 236, upwardly (which is most easily done by pushing the inner switch member terminal end 238 with one's thumb while grasping the protrusion 230 with one's forefingers). This action returns the assembly to the state shown in FIG. 2B.

A second example of a switch assembly 300 is illustrated in FIGS. 3A-3J, wherein an elongated switch member 320 disables and enables a hoist assembly (such as the hoist assembly 10) using a pull-twist action: urging the switch member 320 in an axial sense oriented along the length of the switch member 320 disables (or conversely enables) the hoist assembly 10, and urging the switch member 320 in a second direction rotationally oriented about the length of the elongated switch member 320 places the hoist assembly 10 in the opposite state. A switch actuating member 350 is linked to the switch member 320 (see, e.g., FIG. 3D) to move with the switch member 320 along a path defined by a switch enclosure 370. During such motion, the switch actuating member 350 engages or releases a switch 390 to place the hoist assembly 10 in the enabled state (FIGS. 3B-3D) or the disabled state (FIGS. 3E-3J). The switch enclosure 370 has a slot 372 defined therein, and the switch actuating member 350 has a protruding cam member 352 which extends into the slot 372, wherein urging the switch member 320 in at least one of the aforementioned first (axial) direction and the second (rotational) direction drives the cam member 352 along the slot 372. The slot 372 has opposing slot ends 374 and 376 with a slot midsection 378 therebetween, with the slot 372 being angled or curved such that the slot midsection 378 is located closer to the switch member operating end 322 than the slot ends 374 and 376 (see particularly FIGS. 3B, 3E, and 3H). Thus, when the switch member 320 is urged in an axial sense oriented along the length of the switch member 320, the switch cam member 352 moves along the slot 372 from a first slot end 374 in both an axial direction and a rotational direction owing to the shape/orientation of the slot 372 (compare FIGS. 3B-3D with FIGS. 3E-3G). At the same time, the switch actuating member 350 moves relative to the switch 390, with the switch 390 being engaged in FIGS. 3E-3G to place the hoist assembly 10 in the disabled state. This motion is resisted by a spring 394 (FIGS. 3D, 3G, 3J) which biases the switch actuating member 350 with respect to the switch enclosure 370. When the switch member 320 is released, the spring 394 urges the switch member 320 upwardly (FIGS. 3H-3J), with the shape/orientation of the slot 372 further urging the cam member 352 toward a second slot end 376 wherein the cam member 352 is retained (and with the switch remaining engaged by the switch actuating member 350). To change the hoist assembly 10 from the disabled state to the enabled state, a user can then rotationally urge the switch member 320 in a second direction oriented about the length of the elongated switch member 320, defeating the spring 394 and moving the switch cam member 352 along the slot 372 from the position in FIGS. 3H-3I toward that shown in FIGS. 3A-3B. This disengages the switch actuating member 350 from the switch 390, and places the hoist back into the enabled state.

A third example of a switch assembly 400 is illustrated in FIGS. 4A-4C, wherein the elongated switch member 420 disables and enables a hoist assembly 40 (only a section of which is shown) using axial and off-axial motions: urging the switch member 420 in a first direction oriented along the length of the elongated switch member 420 in an axial sense (as shown between FIGS. 4B-4C) places the hoist assembly 40 in the disabled state, and subsequently urging the switch member 420 in a second direction oriented neither along nor parallel to the length of the elongated switch member 420 places the hoist assembly 40 in the enabled state (e.g., by exerting a force on the switch member 420 which is perpendicular to its length). A switch actuating member 450 is rotatably mounted with respect to the hoist assembly 40 at a pivot 456, whereby a swinging end 458 of the switch actuating member 450 can travel into and out of engagement with a switch 490 to place the hoist assembly 40 in the enabled state or the disabled state (where engagement with the switch 490 as in FIG. 4B enables the hoist assembly 40, and disengagement with the switch 490 as in FIG. 4C disables the hoist assembly 40). The switch member 420 has a switch member hoist end 424 opposite its switch member operating end 422 which is pivotally affixed or otherwise linked to the swinging end 458 of the switch actuating member 450. A spring 494 biases the switch actuating member 450 with respect to the hoist assembly 40, and initially resists disengagement of the switch actuating member 450 from the switch 490 when the switch assembly 400 is as shown in FIG. 4B, with tension on the spring 494 increasing as the switch actuating member 450 rotates about the pivot 456 away from the switch 490. However, the spring 494 tension then decreases as the switch actuating member 450 further rotates into the position shown in FIG. 4C, thereby preventing the switch actuating member 450 from rotating back into engagement with the switch 490 unless the switch member 420 is pulled sideways (i.e., in a direction off of the axis of the switch member 420) to pivot the switch actuating member 450 back into the state shown in FIG. 4B.

The foregoing versions of the invention thereby allow a caregiver to both disable and re-enable a hoist (in particular a ceiling hoist) from the floor, without the need to use a stool, ladder, or the like, and the caregiver may do so using dissimilar enabling/disabling motions so that the possibility of accidental re-enablement is reduced. Further advantages, features, and objects of the invention will be apparent from the remainder of this document in conjunction with the associated drawings.

BRIEF DESCRIPTION OF THE DRAWINGS

FIGS. 2A-2D illustrate a first exemplary switch assembly 200 suitable for use with a patient hoist (such as the hoist of FIGS. 1A-1B), wherein:

FIG. 2A is an exploded (disassembled) view of the switch assembly 200 showing its outer and inner switch members 226 and 236 (which together form the switch member 220 of FIGS. 2B-2D), switch actuating member 250, switch enclosure 270, switch 290, and spring 294 (as well as other parts to be discussed below);

FIGS. 2B-2D are side elevational views of a cross-section of the assembled switch assembly 200 of FIG. 2A, showing the switch 290 in an enabled state (FIG. 2B), transitioning into a disabled state as the switch member 220 is pulled (FIG. 2C), and settling into a disabled (but ready to be re-enabled) state when the switch member 220 is released (FIG. 2D), with spacing between the outer and inner switch members 226 and 236.

FIGS. 3A-3J illustrate a second exemplary switch assembly 300 suitable for use with a patient hoist (such as the hoist of FIGS. 1A-1B), wherein:

FIG. 3A is an exploded (disassembled) view of the switch assembly 300 showing its switch member 320, switch actuating member 350, switch enclosure 370, switch 390, and spring 394 (as well as other parts to be discussed below);

FIGS. 3B-3J illustrate the transition of the assembled switch assembly 300 of FIG. 2A from an enabled state (FIGS. 3B-3D), into an intermediate disabled state as the switch member 320 is pulled (FIGS. 3E-3G), and into a final disabled state as the switch member 320 is released (FIGS. 3H-3J), wherein FIGS. 3B, 3E, and 3H are partial perspective views, FIGS. 3C, 3F, and 3I are front elevational views, and FIGS. 3D, 3G, and 3J are side elevational views (with selected components being shown in cross-sections).

FIGS. 4A-4C illustrate a third exemplary switch assembly 400 suitable for use with a patient hoist (such as the hoist of FIGS. 1A-1B), wherein:

FIG. 4A is an exploded (disassembled) view of the switch assembly 400 showing its switch member 420, switch actuating member 450, switch enclosure 470, switch 490, and spring 494 (as well as other parts to be discussed below);

FIG. 4A shows the spring 494 biasing the switch actuating member 450 into engagement with the switch 490 to place the switch assembly 400 in an enabled state; and FIG. 4B shows the arrangement of FIG. 4A after the switch member 420 has been pulled in a direction oriented along its axis, with the spring 494 biasing the switch actuating member 450 out of engagement with the switch 490 to place the switch assembly 400 in a disabled state, and wherein an off-axis force (e.g., a force exerted perpendicularly to the axis of the switch member 420, and leftwardly in FIG. 4C) will return the switch assembly 400 to the state shown in FIG. 4A.

DETAILED DESCRIPTION OF PREFERRED VERSIONS OF THE INVENTION

Expanding on the discussion above, the exemplary versions of the invention illustrated in the accompanying drawings will now be discussed in greater detail.

Figure 2A:
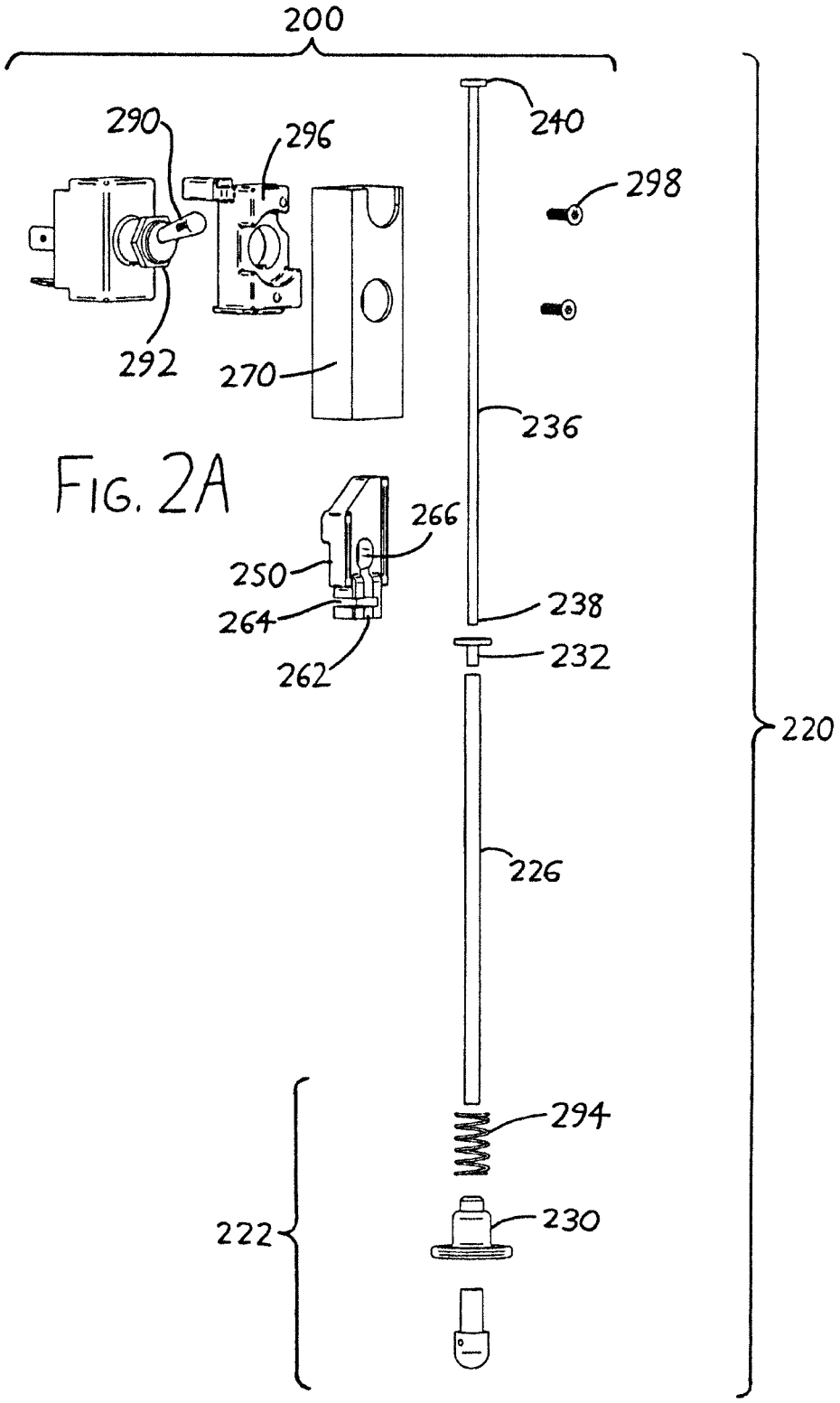
Figures 2B, 2C, 2D:
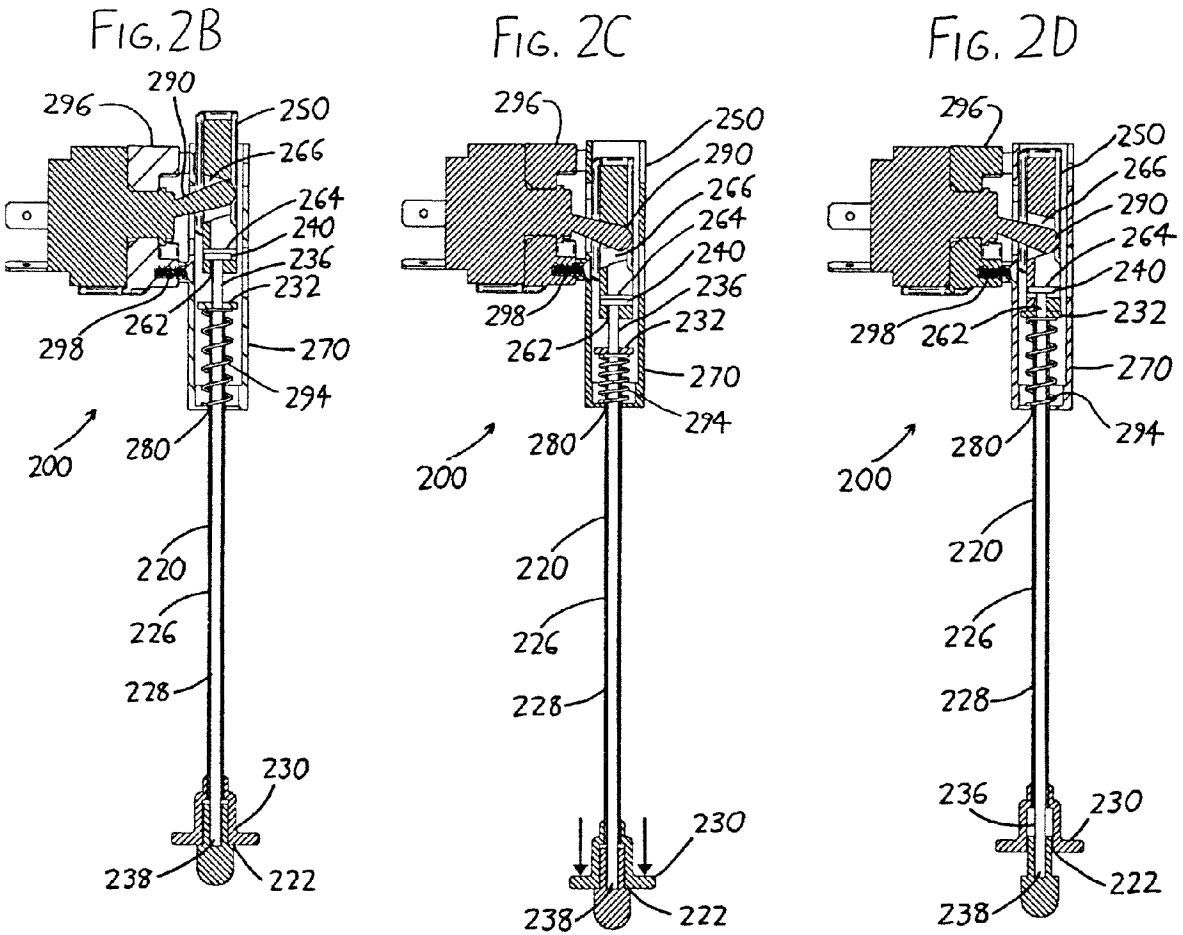

Initially looking at the "pull-push" switch assembly of FIGS. 2A-2D, FIG. 2A illustrates its component parts in exploded (disassembled) form, and these parts can be assembled in the following manner. The outer switch member 226 can be assembled by installing the protrusion 230 at one of its ends (as shown in FIGS. 2B-2D). The opposite end of the outer switch member 226 is then inserted within a switch enclosure bottom opening 280 (seen in FIGS. 2B-2D), the spring 294 is situated about the outer switch member 226 within the switch enclosure 270, and a spring retainer 232 is installed on the upper end of the outer switch member 226 to retain the spring 294 between the bottom of the switch enclosure 270 and the spring retainer 232. The inner switch member 236, which has a protruding catch 240 at its upper end (see FIG. 2A), is inserted to extend through a switch actuating member bottom opening 262 (FIGS. 2B-2D) with the catch 240 engaged within a slot 264 in the switch actuating member 250 (FIG. 2A). The switch actuating member 250 and inner switch member 236 can then be inserted into the top of the switch enclosure 270, with the inner switch member 236 extending through the spring retainer 232 and within the internal passage 228 of the outer switch member 226 until its lower end extends from the protrusion 230 on the outer switch member 226. The protruding terminal end 238 of the inner switch member 236 can then be installed or otherwise formed on the lower end of the inner switch member 236. Completing the foregoing steps essentially places the various aforementioned components in the assembled form shown in FIG. 2D, save that the switch 290 has not yet been engaged to the switch enclosure 270 and the switch actuating member 250.

As seen in FIG. 2A, the switch 290 takes the form of a conventional toggle switch. An enclosure mount 296 can be installed about the switch 290 by removing a surrounding switch nut 292, slipping the enclosure mount 296 over the switch 290, and then replacing the switch nut 292. The switch enclosure 270, with the switch actuating member 250 and switch member 220 (i.e., the outer and inner switch members 226 and 236) translatably mounted therein, can then be affixed to the enclosure mount 296 via fasteners 298 so that the switch 290 fits within a switch receptacle 266 defined in the switch actuating member 250 (see FIG. 2B).

Looking specifically to FIGS. 2B-2D for a more detailed review of the operation of the switch assembly, FIG. 2B shows the switch 290 in the enabled state, i.e., with the hoist assembly (not shown) in an operational state with the switch actuating member 250 resting atop the switch 290. If a caregiver, patent, or other operator needs to disable the hoist assembly in an emergency or other situation, the operator can grasp and tug the switch member 220 along the exterior of the outer switch member 226, e.g., at the protrusion 230. When this occurs, the arrangement shown in FIG. 2C results: the outer switch member 226 moves downwardly with its protrusion 230 acting against the inner switch member terminal end 238, with the spring retainer 232 of the outer switch member 226 compressing the spring 294 against the bottom of the switch enclosure 270, and with the downward motion of the inner switch member 236 pulling the switch actuating member 250 downwardly within the switch enclosure 270 at the catch 240. As a result, the switch actuating member 250 acts against the switch 290 to move it to the disabled state. However, when the user then releases the outer switch member 226 and/or its protrusion 230, the spring 294 is free to extend, and pushes the spring retainer 232 (and thus the outer switch member 226) upwardly against the bottom of the switch actuating member 250, and thereby pushes the switch actuating member 250 against the bottom of the toggle switch 290 (see FIG. 2D). As a result, the spacing that formerly existed between the switch actuating member 250 and the bottom of the switch 290 is shifted to occur between the protrusion 230 of the outer switch member 226 and the inner switch member terminal end 238. When the operator subsequently wishes to re-enable the hoist assembly, the user can simply push the inner switch member terminal end 238 upwardly with respect to the outer switch member 226, as by grasping the protrusion 230 of the outer switch member 226 between one's forefingers while pushing on the inner switch member terminal end 238 with one's thumb. This has the effect of returning the switch assembly 200 to the state shown in FIG. 2B.

Figure 3A:
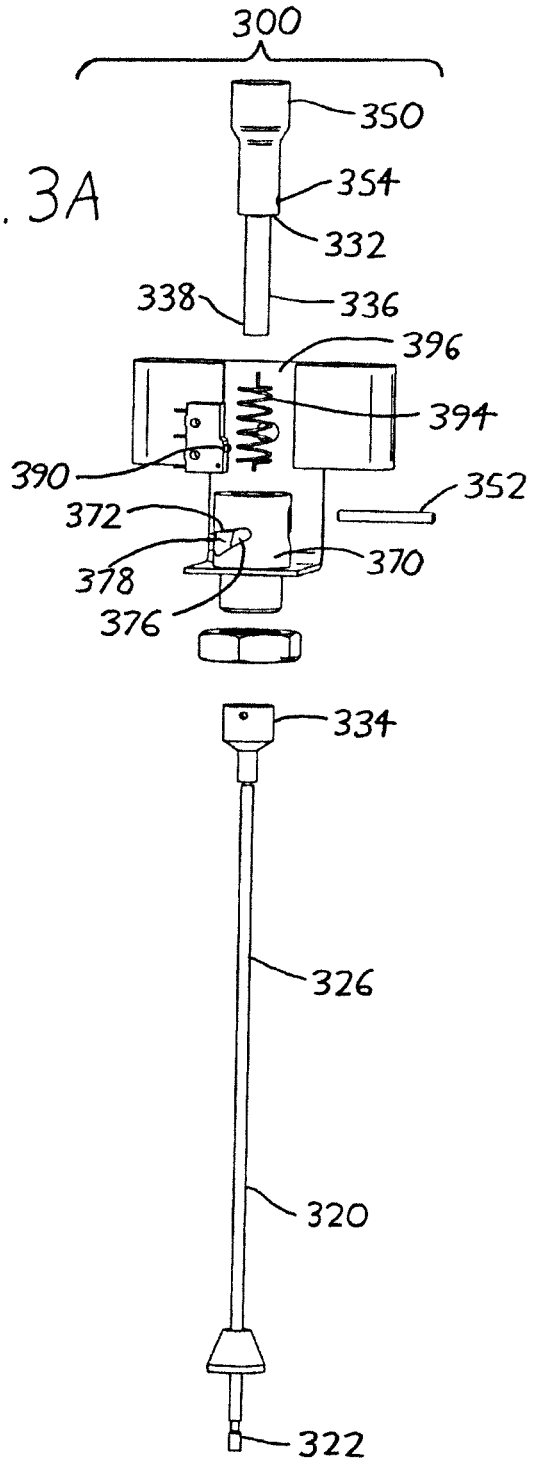

Turning then to the exemplary switch assembly 300 of FIG. 3A, here the switch 390 takes the form of a normally closed contact switch which opens upon being depressed, and is provided on an enclosure mount 396 which also bears the switch enclosure 370 wherein the switch member 320 is translatably and rotatably mounted. The switch member 320 can be formed in multiple sections, here as an outer switch member 326 extending between the switch member operating end 322 and a socket end 334, and an inner switch member 336 extending from a inner switch member terminal end 338 (which fits into the socket end 334) to a switch actuating member 350 having a bottom surface that serves as a spring retainer 332. The cam member 352 is depicted as a pin which fits within a cam member aperture 354 formed in the switch actuating member 350, but the cam member 352 can be molded onto or otherwise formed with the switch actuating member 350.

Figure 3B:
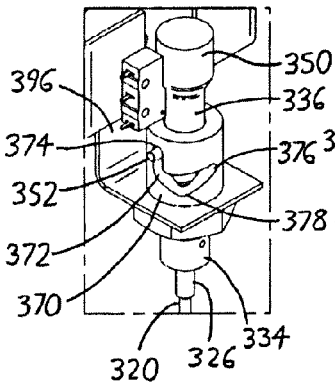
Figure 3C:
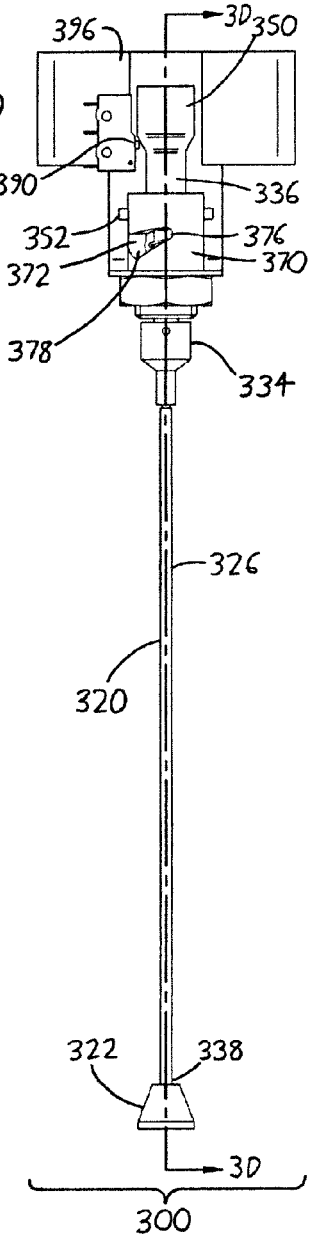
Figure 3D:
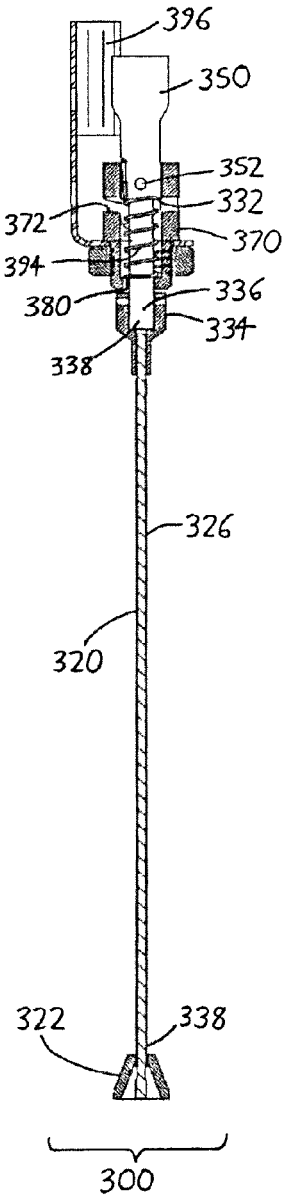
Figure 3E:
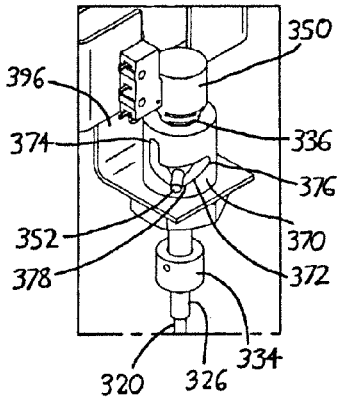
Figure 3F:
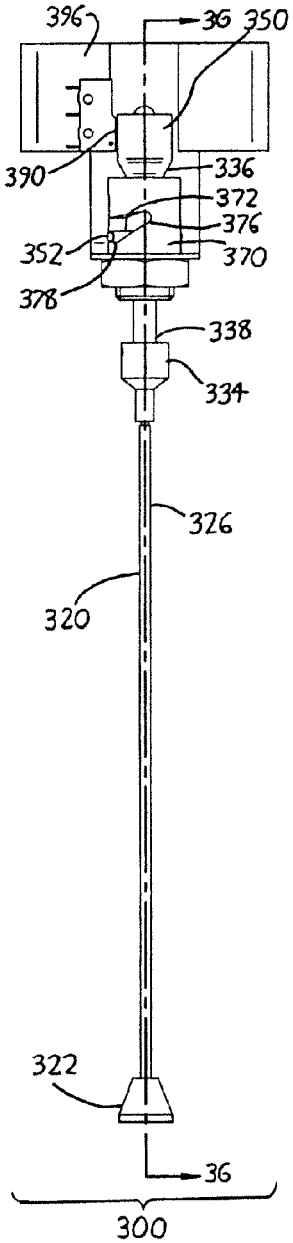
Figure 3G:
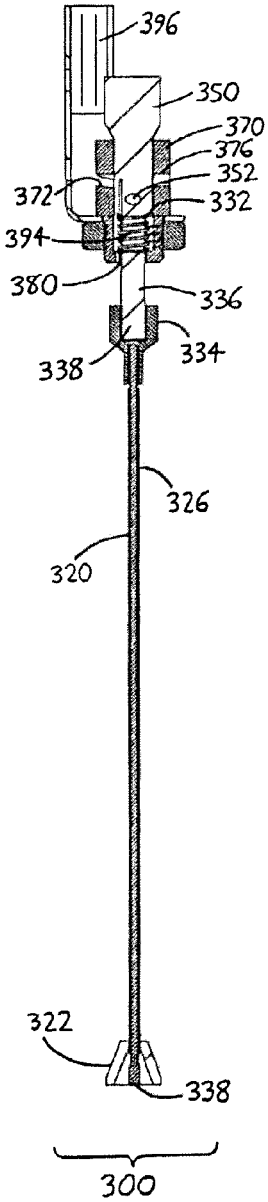
Figure 3H:
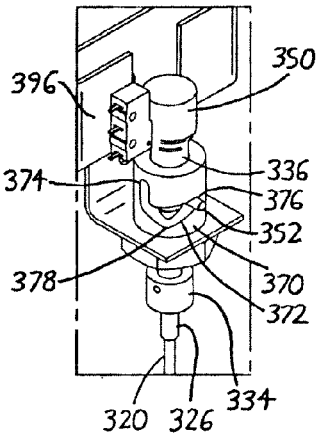
Figure 3I:
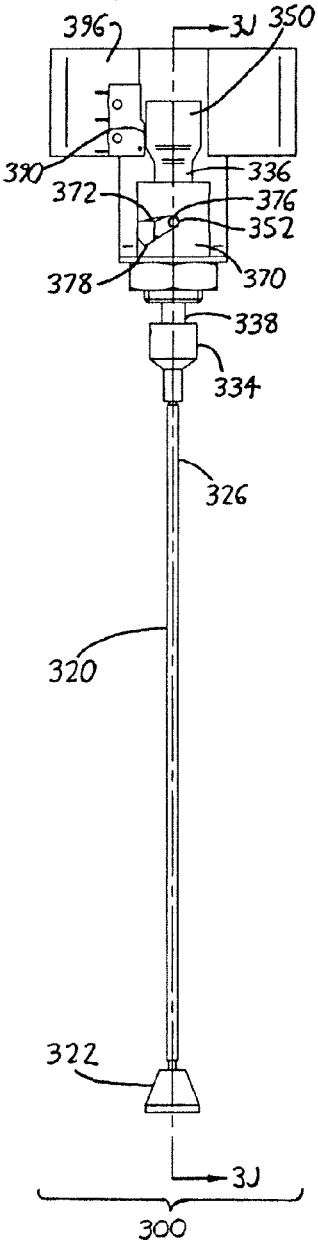
Figure 3J:
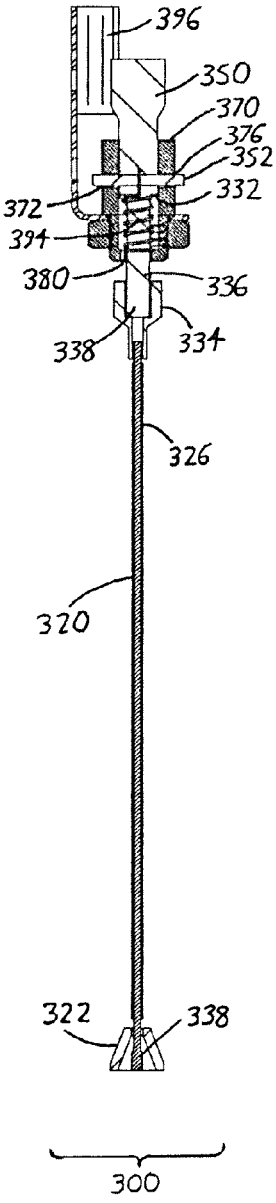

To assemble the switch assembly 300 from the disassembled state shown in FIG. 3A, the spring 394 may be fit about the inner switch member 336 to abut the spring retainer 332, and the inner switch member 336 may then be downwardly inserted into the switch enclosure 370 until the inner switch member terminal end 338 extends from its switch enclosure bottom opening 380 (seen in FIGS. 3D/3G/3J). The socket 334 of the outer switch member 326 can then be fit about the inner switch member terminal end 338, thereby constructing the length of the switch member 320. The cam member 352 is inserted within the switch enclosure slot 372 to be received within the cam member aperture 354, thereby completing the switch assembly 300 as illustrated in FIGS. 3B-3J.

Turning next to FIGS. 3B-3J to review the operation of the switch assembly 300, FIGS. 3B-3D show the switch 390 in an enabled state. Pulling the switch member 320 downwardly causes the cam member 352 to travel within the slot 372 from the position shown in FIG. 3B to the position shown in FIG. 3E, with the switch actuating member 350 simultaneously engaging the switch 390 to disable the hoist assembly (not shown). Releasing the switch member 320 then causes the spring 394 to drive the cam member 352 upwardly, and owing to the shape of the slot 372, also toward the second slot end 376. The force of the spring 394 then retains the switch member 320 in place, with the switch actuating member 350 maintaining the switch 390 in the disabled state, until the switch member 320 is twisted by a user to move the cam member 352 from the position shown in FIGS. 3H-3J back to the position shown in FIGS. 3B-3D. It is notable that depending on the nature of the spring 394, the motion of the cam member 352 within the slot 372 may be assisted and/or resisted by torsional forces exerted by the spring 394. The shape of the slot 372 may therefore be substantially different from that shown in FIGS. 3A-3J, depending on the nature of the spring 394. The slot 372 need not even be present on the switch enclosure 370 depending on the interaction of the switch actuating member 350 and the switch enclosure 370, e.g., the cam member 352 might protrude from an interior wall of the switch enclosure 370 into a slot on the switch actuating member 350 instead.

Figure 4A:
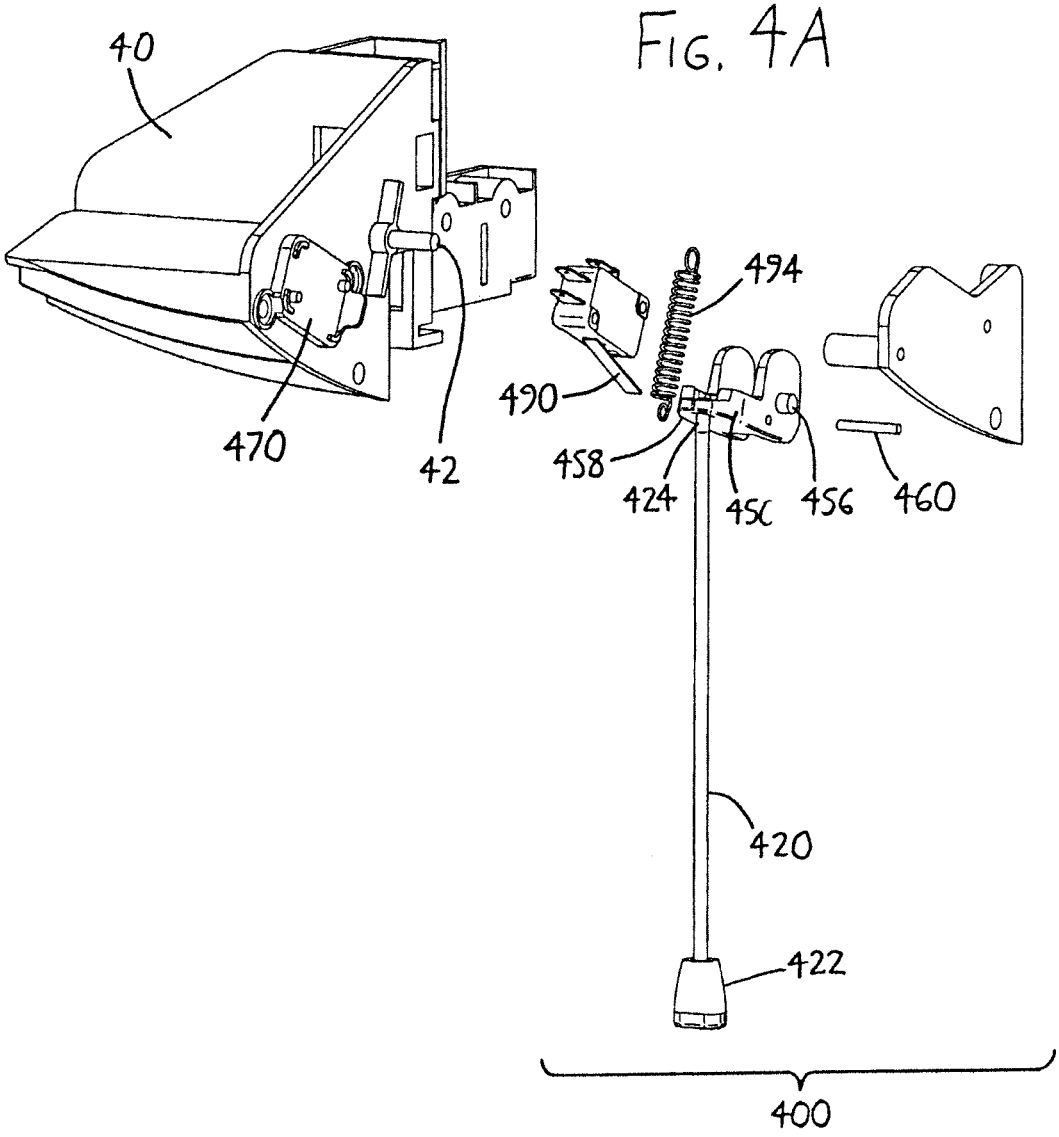
Figure 4B:
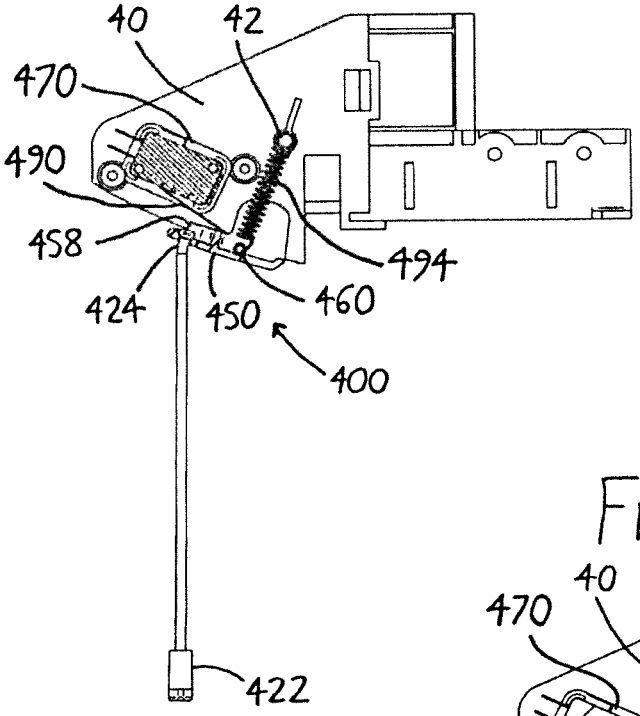
Figure 4C:
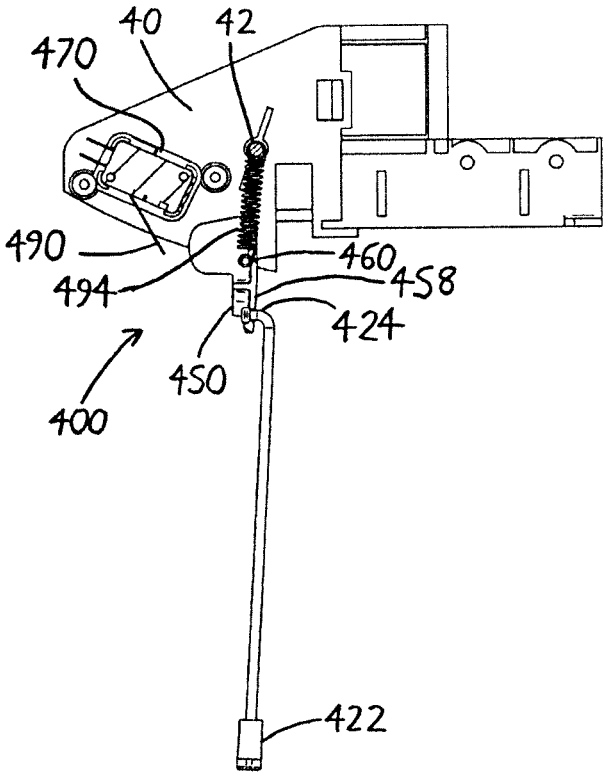

The exemplary switch assembly 400 of FIGS. 4A-4C is shown in FIG. 4A in disassembled form along with a section of a hoist assembly 40 wherein the switch assembly 400 is installed. A normally open momentary contact switch 490 is provided on the hoist assembly 40 at a switch enclosure 470. The switch member 420—which is preferably rigid, but which may be provided as a flexible cord or the like—is pivotally affixed to a switch actuating member 450, which is in turn pivotally affixed to the hoist assembly 40 at a pivot 456 such that the switch actuating member 450 can swing into and out of engagement with the switch 490 (see FIGS. 4B-4C). A spring 494 extends from a mounting post 460 on the switch actuating member 450 to a mounting post 42 on the hoist assembly 40 to bias the switch actuating member 450 with respect to the hoist assembly 40, and thus with respect to the switch 490 within the switch enclosure 470 thereon. Since the distance between the spring mounting post 460 and the spring mounting post varies as the switch actuating member 450 pivots, the spring actuating member may rotate between two positions of lower spring tension—the position shown in FIG. 4B, and the position shown in FIG. 4C—and intermediate positions where spring tension is higher. Thus, the switch actuating member 450 is selectively biased toward, and will remain in, the positions shown in FIG. 4B and FIG. 4C unless it is urged out of one of these positions by an operator's action on the switch member 420.

To review the operation of the switch assembly 400, when the switch assembly is in the enabled state shown in FIG. 4B with the spring 494 urging the switch actuating member 450 against the switch 490, a user may disable the switch assembly by pulling the switch member 420 downwardly. This rotates the switch actuating member 450 against the force of the spring 494, with the switch actuating member 450 disengaging the switch 490 as it moves to the position shown in FIG. 4C. When the switch member 420 and switch actuating member 450 are situated as shown in FIG. 4C, further pulling on the switch member 420 will have no effect, and pushing on the switch member 420 in a direction along its axis (as oriented in FIG. 4C) tends to rotationally urge the swinging end 458 of the switch actuating member 450 even further away from the switch 490 and thereby leave the switch assembly 400 in the disabled state. Thus, to defeat the spring 494 and move the swinging end 458 of the switch actuating member 450 back into engagement with the switch 490 (as shown in FIG. 4B), a user must exert "off-axis" force on the switch member 420, e.g., a force oriented perpendicularly to the length of the switch member 420, or a moment exerted at the switch actuating member operating end 422 (with the axis of the moment oriented parallel to the axis about which the switch actuating member 450 pivots).

It is emphasized that the versions of the invention described above are merely exemplary, and the invention is not intended to be limited to these versions. To illustrate, following is an exemplary list of modifications that might be made to the foregoing versions.

Figure 1A:
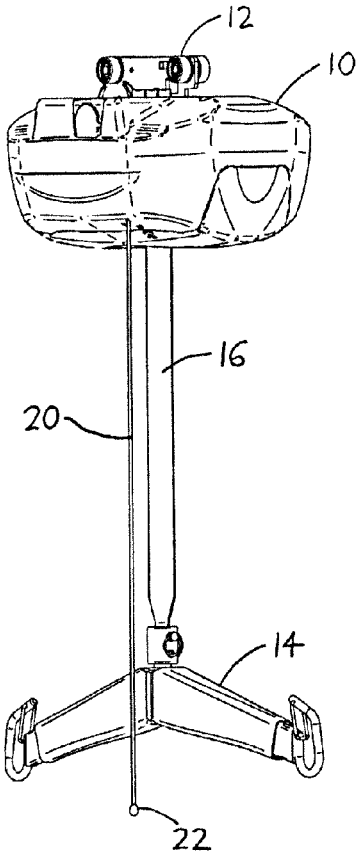
FIG. 1A is a perspective view of an exemplary (ceiling) hoist having a hoist assembly 10 bearing a trolley 12 for riding along a ceiling-mounted track (not shown), a lifting member 14 (a spreader bar) descending from the hoist assembly 10 on a strap 16, and an elongated switch member 20 descending from the hoist assembly 10.
Figure 1B:
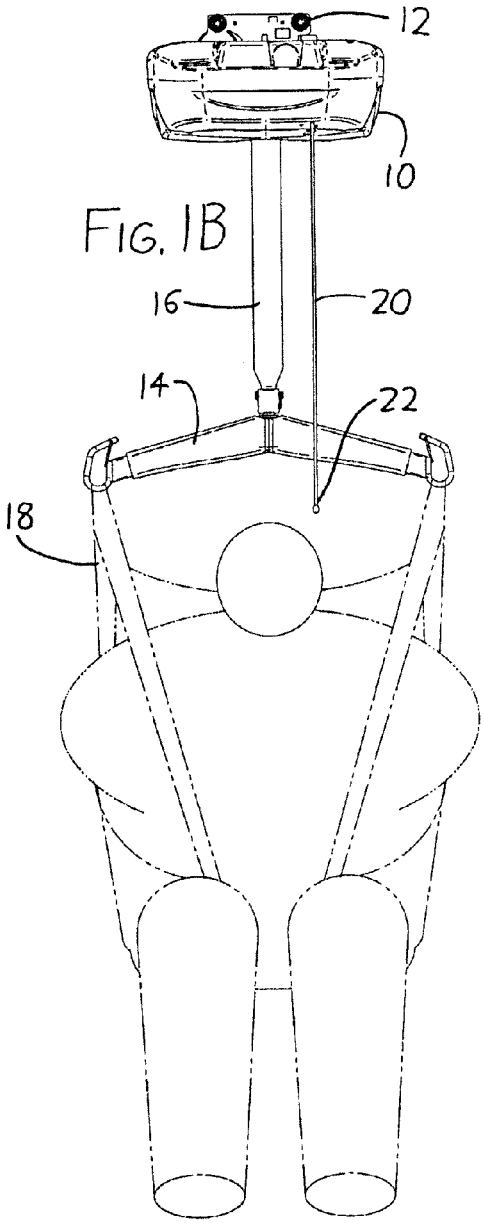
FIG. 1B is an elevated front view of the hoist of FIG. 1A, showing (in phantom/dashed lines) an exemplary patient sling on the spreader bar 14, with a patient situated within the sling.

Initially, the configurations of the hoist assembly 10 and lifting member 14 shown in FIGS. 1A-1B are merely exemplary, and the switch assemblies 200, 300, and 400 described above can be used with hoist assemblies and/or lifting members having vastly different appearances and operation. For example, switch assemblies defined by the claims below could be utilized with mobile (or stationary) stanchion-mounted hoists rather than mobile (or stationary) ceiling hoists. Lifting members can assume any appropriate form for lifting a patient (or for lifting legs, arms, or other portions of a patient), e.g., single- or multiple-loop slings, hammocks, seats, etc., with or without spreader bars or other supporting frames. Hoist assemblies might have vastly different configurations and functions than those shown in FIGS. 1A-1B, and could include more than one lifting member that can be raised and lowered; for example, the hoist assembly 10 might include two or more straps 16 which each supports its own lifting member 14. Raising and lowering of such multiple lifting members might be simultaneously enabled and disabled by the same switching assembly, or independently enabled and disabled by separate switch assemblies.

The switch assemblies 200, 300, and 400 and the components therein can also have appearances and operation different from those reviewed above. Using the switch assembly 200 as an example, components may be integrally formed or otherwise combined where appropriate; to illustrate, the protrusion 230 (FIG. 2A) can be molded or otherwise directly formed on the outer switch member 226. Conversely, components can be formed of multiple separate subcomponents where appropriate, e.g., the switch enclosure 270 (FIG. 2A) might assume the form of spaced L-brackets, or spaced rectangular loops, situated along the enclosure mount 396 to restrain the switch actuating member 250 to translate along the same path as the one it travels in FIGS. 2B-2D. Where appropriate, components depicted in the drawings can also be substituted with structural and functional equivalents, as by removing the illustrated switch enclosure 270 (FIG. 2A) altogether, and restraining the switch actuating member 250 to translate with respect to the enclosure mount 396 (as by forming a slot along the length of the switch actuating member 250 into which a flange protruding from the enclosure mount 396 extends). Components can also be modified to have fewer or greater structural and/or functional features, e.g., the switch member 220 could be formed with contoured handles (as by placing finger ridges on the outer switch member 226), a handle loop (as by replacing the protrusion 230 with a loop extending about the inner switch member terminal end 238), or other easily-grasped extensions, and it need not extend along a straight axis (i.e., the outer and inner switch members 226 and 236 could be at least partially curved). The switch 290 could use knife, reed, or other non-toggle switching mechanisms; could use either momentary or fixed-state connections upon actuation; and could use different operating principles (electrical, magnetic, optical, etc.). An ordinary artisan can, after review of the switch assemblies 200, 300, and 400, devise these and numerous other variations for the switch assemblies.

The exemplary versions of the invention shown in the drawings and described above operate on the basis of axial and contra-axial (i.e., pull and push) switch action (as in FIGS. 2A-2D), axial and rotational switch action (as in FIGS. 3A-3J), and axial and off-axial switch action (as in FIGS. 4A-4C), but it should be understood that other types of switch actions are possible wherein the hoist-enabling and hoist-disabling switch motions are different (e.g., rotary and off-axial switch action).

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A patient lift including:

a lifting member;

a hoist assembly connected to the lifting member, the hoist assembly having:

an enabled state wherein the hoist assembly can move the lifting member between a raised position and a lowered position, the raised position disposed closer to the hoist assembly than the lowered position, and a lowered position disposed farther from the hoist assembly than the raised position, and a disabled state wherein the hoist assembly cannot move the lifting member between the raised position and the lowered position; and a switch assembly comprising a switch provided on the hoist assembly and an elongated switch member having a first end descending from the switch and a second end opposite the first end, the second end being below the raised position and above the lowered position, wherein manually actuating the switch member in a first direction oriented in an axial sense along the length of the elongated switch member, or in a rotational sense about the length of the elongated switch member, actuates the switch provided on the hoist assembly, thereby placing the hoist assembly in one of the enabled state or the disabled state, and manually actuating the switch member in a second direction oriented differently than the first direction actuates the switch provided on the hoist assembly, thereby placing the hoist assembly in the other of the enabled state and the disabled state.

2. The patient lift of claim 1 further including a patient support sling removably fit on the lifting member.

3. The patient lift of claim 1 wherein actuating the switch member in a first direction oriented along the length of the elongated switch member in an axial sense places the hoist assembly in the disabled state.

4. The patient lift of claim 3 wherein axially actuating the switch member in a second direction oriented along the length of the elongated switch member, and opposite the first direction, places the hoist assembly in the enabled state.

5. The patient lift of claim 3 wherein rotationally actuating the switch member in a second direction oriented about the length of the elongated switch member places the hoist assembly in the enabled state.

6. The patient lift of claim 5 wherein actuating the switch member in the first direction oriented along the length of the elongated switch member in an axial direction also rotationally urges the switch member in a direction opposite the second direction.

7. The patient lift of claim 3 wherein axially actuating the switch member in a second direction oriented neither along nor parallel to the length of the elongated switch member places the hoist assembly in the enabled state.

8. The patient lift of claim 1 wherein the elongated switch member includes: an elongated outer switch member; and an elongated inner switch member telescopically fit within the outer switch member.

9. The patient lift of claim 1 wherein the elongated switch member includes: an elongated outer switch member having: an internal passage along its length; and an outer circumference having a protrusion extending therefrom adjacent the second end of the switch member; and an elongated inner switch member, wherein at least a substantial portion of the length of the inner switch member is disposed within the internal passage of the outer switch member, and movable therein in an axial direction along the length of the elongated switch member, and wherein the inner switch member has a terminal inner switch member end protruding from the outer switch member adjacent the protrusion.

10. The patient lift of claim 9 wherein the outer switch member is biased to urge the protrusion in a direction away from the terminal inner switch member end.

11. The patient lift of claim 9 further including: a switch enclosure; a switch actuating member linked to the inner switch member to move therewith along a path defined by the switch enclosure; and as itch actuated by the switch actuating member, wherein the actuation of the switch places the hoist assembly in the enabled state or the disabled state.

12. The patient lift of claim 11 further including a spring biasing the outer switch member with respect to the switch enclosure.

13. The patient lift of claim 1 further including: a switch enclosure; a switch actuating member movable along a path defined within the switch enclosure when the switch member is urged in the first or second direction; and a switch actuated by the switch actuating member, wherein the actuation of the switch places the hoist assembly in the enabled state or the disabled state.

14. The patient lift of claim 13 wherein one of the switch actuating member and the switch enclosure has a cam member protruding therefrom, and the other of the switch actuating member and the switch enclosure has a slot defined therein, wherein actuating the switch member in at least one of the first direction and the second direction drives the cam member along the slot.

15. The patient lift of claim 14 wherein the slot has opposing slot ends with a slot midsection therebetween, and the slot midsection is located closer to the second end of the switch member than the slot ends.

16. The patient lift of claim 13 wherein the elongated switch member includes: an elongated outer switch member having an internal passage along its length, and biased toward the switch actuating member; and an elongated inner switch member movably situated within the internal passage, and linked to the switch actuating member to move therewith.

17. The patient lift of claim 16 wherein the outer switch member has an outer circumference with a protrusion extending therefrom adjacent the second end of the switch member, and the inner switch member has a terminal inner switch member end protruding from the outer switch member adjacent the protrusion.

18. The patient lift of claim 1 further including: a switch enclosure; a switch actuating member linked to the switch member to move therewith along a path defined by the switch enclosure, wherein actuating the switch member in an axial sense oriented along the length of the switch member also rotates the switch member about the length of the switch member; and a switch actuated by the switch actuating member, wherein the actuation of the switch places the hoist assembly in the enabled state or the disabled state.

19. The patient lift of claim 18 wherein one of the switch actuating member and the switch enclosure has a cam member protruding therefrom, and the other of the switch actuating member and the switch enclosure has a slot defined therein, wherein actuating the switch member in an axial sense oriented along the length of the switch member drives the cam member along the slot.

20. The patient lift of claim 1 wherein the switch member includes a switch member hoist end provided adjacent the first end of the switch member, and the switch member hoist end traverses a curved path as the switch member is actuated along either of the first and second directions.

21. The patient lift of claim 20 further including a switch actuating member rotatably mounted with respect to the hoist assembly at a pivot, and having a swinging end spaced from the pivot, the swinging end having the switch member hoist end attached thereon.

22. The patient lift of claim 1 further including: a switch actuating member rotatably mounted with respect to the hoist assembly at a pivot, and having a swinging end spaced from the pivot, the swinging end having the switch member mounted thereon; and a switch, wherein the switch actuating member is rotatable about the pivot into and out of engagement with the switch, and the switch is actuated by engagement with the switch actuating member, wherein the actuation of the switch places the hoist assembly in the enabled state or the disabled state.

23. The patient lift of claim 22 wherein the switch member is pivotally affixed to the swinging end of the switch actuating member.

24. The patient lift of claim 22 further including a spring biasing the switch actuating member with respect to the hoist assembly.

25. The patient lift of claim 24 wherein the switch actuating member rotates about the pivot between an engaged position in engagement with the switch, and a disengaged position out of engagement with the switch, and wherein tension on the spring increases as the switch actuating member rotates about the pivot between the engaged position and the disengaged position.

26. The patient lift of claim 1 wherein the second end comprises an actuating portion and wherein actuating the actuating portion in the first direction places the hoist assembly in the disabled state, the first direction being substantially along the length of the elongated switch member and away from the hoist assembly.

27. A patient lift including:

a hoist assembly with a lifting member descending therefrom, the hoist assembly having:

an enabled state wherein the hoist assembly can raise and lower the lifting member in a vertical direction;

a disabled state wherein the hoist assembly cannot raise and lower the lifting member in a vertical direction; and a height measured in the vertical direction; and a switch assembly comprising a switch provided on the hoist assembly and an elongated switch member descending from the switch and movably mounted to the hoist assembly to position the hoist assembly in the enabled and disabled states, the elongated switch member having a first end descending from the hoist assembly and a second end opposite the first end, the elongated switch member having a length measured in the vertical direction which is at least substantially the same as, or greater than, the height of the hoist assembly, wherein manually actuating the switch member in a first direction oriented along the length of the elongated switch member in an axial sense, or in a direction oriented about the length of the elongated switch member in a rotational sense, actuates the switch provided on the hoist assembly, thereby placing the hoist assembly in one of the enabled state or the disabled state, and manually actuating the switch member in a second direction different from the first direction actuates the switch provided on the hoist assembly, thereby placing the hoist assembly in the other of the enabled state and the disabled state.

28. The patient lift of claim 27 wherein the second end comprises an actuating portion and wherein actuating the actuating portion in the first direction places the hoist assembly in the disabled state, the first direction being substantially along the length of the elongated switch member and away from the hoist assembly.

29. A patient lift including:

a hoist assembly having a height measured in a vertical direction;

a lifting member supported by the hoist assembly, wherein the hoist assembly has:

an enabled state wherein the hoist assembly can selectively raise and lower the lifting member and a disabled state wherein the hoist assembly cannot selectively raise and lower the lifting member; and a switch assembly comprising a switch provided on the hoist assembly and an elongated switch member having a first end extending from the switch and a second end opposite the first end, the second end situated below the hoist assembly, wherein manually actuating the switch member in a first direction oriented either along the length of the elongated switch member in an axial sense, or about the length of the elongated switch member in a rotational sense, actuates the switch provided on the hoist assembly, thereby placing the hoist assembly in one of the enabled state or the disabled state; and manually actuating the switch member in a second direction which is different than the first direction actuates the switch provided on the hoist assembly, thereby placing the hoist assembly in the other of the enabled state and the disabled state.

30. The patient lift of claim 29 wherein the first end comprises a protrusion and wherein axial movement of the first end in the second direction places the hoist assembly in the enabled state, the second direction being substantially along the length of the elongated switch member and towards the hoist assembly.

* * * * *